US007281297B2

(12) United States Patent
Peacock et al.

(10) Patent No.: US 7,281,297 B2
(45) Date of Patent: Oct. 16, 2007

(54) FLOOR CLEANING APPARATUS EQUIPPED WITH MULTIPLE AGITATORS AND AN AGITATOR HOOD WITH BAFFLE

(75) Inventors: Dale M. Peacock, Lexington, KY (US); Jason D. Bowden, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 561 days.

(21) Appl. No.: 10/832,012

(22) Filed: Apr. 26, 2004

(65) Prior Publication Data

US 2004/0216265 A1 Nov. 4, 2004

Related U.S. Application Data

(60) Provisional application No. 60/466,603, filed on Apr. 30, 2003.

(51) Int. Cl.
*A47L 5/30* (2006.01)

(52) U.S. Cl. ..... 15/384; 15/415.1

(58) Field of Classification Search ..... 15/384, 15/387, 388; *A47L 5/30*
See application file for complete search history.

(56) References Cited

U.S. PATENT DOCUMENTS

| | | | | |
|---|---|---|---|---|
| 1,268,963 | A * | 6/1918 | Gray | 15/384 |
| 1,347,166 | A | 7/1920 | Kirby | |
| 1,938,068 | A * | 12/1933 | Deutscher | 15/384 |
| 3,936,905 | A | 2/1976 | Stewart et al. | |
| 3,942,216 | A | 3/1976 | Minton | |
| 4,023,234 | A | 5/1977 | Martinec et al. | |
| 4,198,727 | A | 4/1980 | Farmer | |
| 4,219,902 | A | 9/1980 | DeMaagd | |
| 4,426,751 | A | 1/1984 | Nordeen | |
| 5,249,332 | A * | 10/1993 | Wilkerson | 15/384 |
| 5,513,418 | A * | 5/1996 | Weber | 15/383 |
| 6,006,402 | A | 12/1999 | Maurer et al. | |
| 6,039,817 | A | 3/2000 | Payne | |
| 6,052,866 | A | 4/2000 | Tuvin et al. | |
| 6,237,189 | B1 | 5/2001 | Maurer et al. | |
| 6,289,552 | B1 | 9/2001 | McCormick | |
| 6,539,577 | B1 * | 4/2003 | Kamatani et al. | 15/383 |
| 6,615,445 | B2 * | 9/2003 | Worwag | 15/387 |
| 7,100,234 | B2 * | 9/2006 | Weber et al. | 15/384 |
| 2003/0188396 | A1 | 10/2003 | Hitzelberger | |

OTHER PUBLICATIONS

U.S. Appl. No. 10/788,809, filed on Feb. 27, 2004; entitled Nozzle Assembly With Edge Cleaning Through Agitator Cavity.

* cited by examiner

*Primary Examiner*—Theresa T. Snider
(74) *Attorney, Agent, or Firm*—King & Schikli, PLLC

(57) ABSTRACT

A floor cleaning apparatus includes a nozzle assembly including a housing and a cooperating hood defining an agitator cavity. First and second agitators are carried by the nozzle assembly in the agitator cavity. A canister assembly is connected to the nozzle assembly. The apparatus also includes a suction generator and a dirt collector. The apparatus is characterized by the hood which includes a wall and a baffle. A first section of the wall and the baffle define a first channel that receives the first agitator. A second section of the wall and the baffle define a second channel that receives the second agitator.

10 Claims, 5 Drawing Sheets

FLOOR CLEANING APPARATUS EQUIPPED WITH MULTIPLE AGITATORS AND AN AGITATOR HOOD WITH BAFFLE

This application claims the benefit of U.S. Provisional Patent Application Ser. No. 60/466,603 filed on Apr. 30, 2003.

TECHNICAL FIELD

The present invention relates generally to the floor care equipment field and, more particularly, to a vacuum cleaner or other floor care device equipped with an agitator hood having a baffle for controlling air flow into the vacuum cleaner.

BACKGROUND OF THE INVENTION

Upright vacuum cleaners in all of their designs and permutations have become increasingly popular over the years. The upright vacuum cleaners generally incorporate a nozzle assembly and a canister assembly pivotally mounted to the nozzle assembly. Wheels on the nozzle and canister assemblies allow the vacuum cleaner to smoothly ride over the surface to be cleaned.

The canister assembly includes an operating handle that is manipulated by the user to move the vacuum cleaner back-and-forth across the floor. The canister assembly also includes either a bag-like filter or a separation chamber and filter combination that trap dirt and debris while substantially clean air is exhausted by a fan that is driven by an onboard electric motor. It is this fan and motor arrangement that generates the drop in air pressure necessary to provide the desired cleaning action.

In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

The present invention relates to a vacuum cleaner equipped with two rotary agitators and a specially designed agitator hood. The agitator hood includes a wall and a baffle that define a pair of channels. An agitator is aligned with and at least partially received in each channel. The channels function to ensure smooth and efficient air flow over the agitators and into the intake opening of the vacuum cleaner thereby providing enhanced cleaning efficiency.

SUMMARY OF THE INVENTION

In accordance with the purposes of the present invention as described herein, an improved floor cleaning apparatus is provided. The apparatus includes a nozzle assembly including a housing and a cooperating hood defining an agitator cavity. First and second agitators are carried by the nozzle assembly in the agitator cavity. A canister assembly is connected to the nozzle assembly. A suction generator is carried by one of the canister assembly and the nozzle assembly. Additionally, a dirt collector is carried by one of the canister assembly and the nozzle assembly.

The hood includes a wall and a baffle. A first section of the wall and the baffle define a first channel receiving at least a first portion of the first agitator and a second section of the wall and the baffle define a second channel receiving at least a second portion of the second agitator. In addition, an intake opening is provided in the first section of the wall.

Further, the hood includes a first sidewall and a second sidewall. In one possible embodiment, the intake opening is positioned adjacent the first sidewall.

The first agitator extends across the first channel between the first sidewall and the second sidewall. Similarly, the second agitator extends across the second channel between the first sidewall and the second sidewall. A baffle extends from the second sidewall toward the first sidewall at least partially between the first and second agitators. A gap is provided between the first sidewall and the baffle. The gap is at least partially aligned with the intake opening and provides a direct air flow pathway from the second channel through the first channel to the intake opening.

In accordance with an additional aspect of the present invention, a first air guide rib is carried on the first section of the wall. Similarly, a second air guide rib is carried on the second section of the wall. Further, the baffle projects from the wall a distance $D_1$ and the first and second air guide ribs project from the wall a distance $D_2$ where $D_1$ is about three to about five times greater than $D_2$.

BRIEF DESCRIPTION OF THE DRAWING FIGURES

The accompanying drawing incorporating and forming a part of the specification, illustrates several aspects of the present invention, and together with the description serves to explain certain principles of the invention. In the drawing.

DETAILED DESCRIPTION OF THE INVENTION

Figure 1:
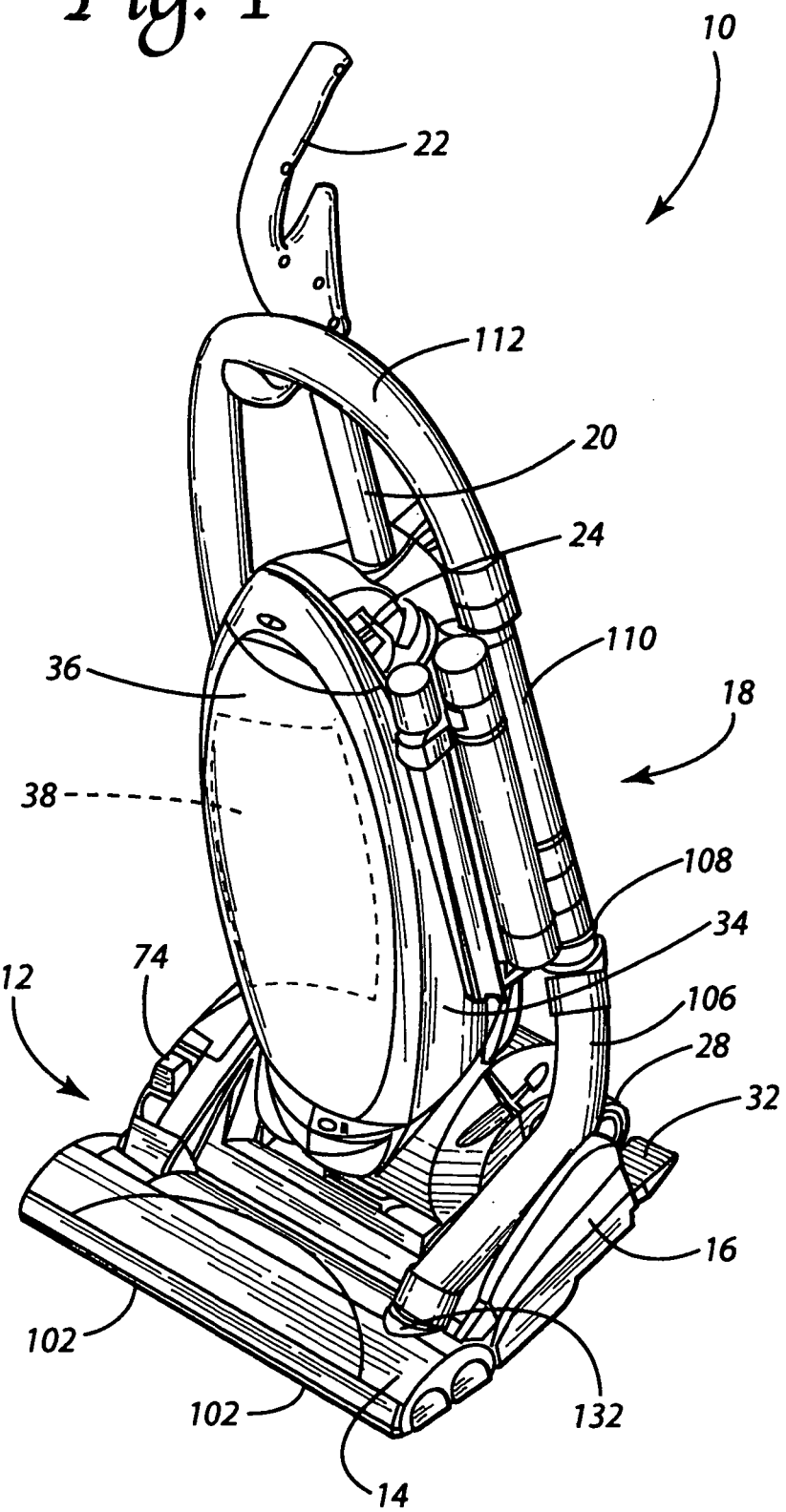
FIG. 1 is a perspective view of an upright vacuum cleaner of the present invention.
Figure 2:
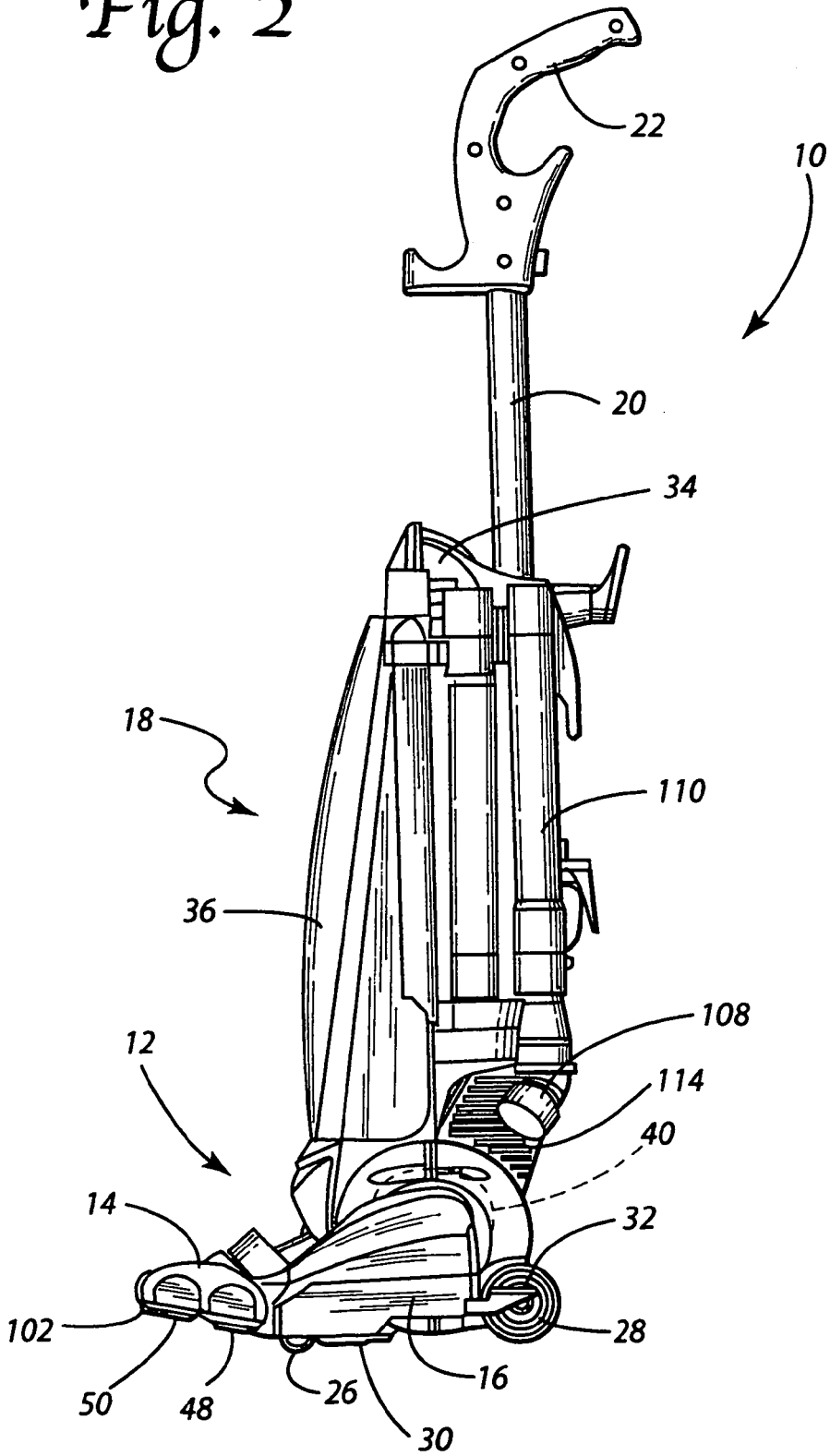
FIG. 2 is a side elevational view of the upright vacuum cleaner shown in FIG. 1.

Reference is now made to FIGS. 1 and 2 showing the upright vacuum cleaner 10 of the present invention. The upright vacuum cleaner 10 includes a nozzle assembly 12, comprising both an agitator section 14 and base section 16, and a canister assembly 18. The canister assembly 18 further includes a control handle 20 and a hand grip 22. A control switch 24 is provided for turning the vacuum cleaner 10 on and off. Electrical power may be supplied to the vacuum cleaner 10 from a standard electrical wall outlet through an electrical cord (not shown) in a manner well known in the art. Alternatively, the vacuum cleaner 10 could be powered by an onboard battery or batteries.

The vacuum cleaner 10 glides over the surface to be cleaned by means of a pair of front wheels 26 and a pair of rear wheels 28 (only one of each illustrated in FIG. 2). The front wheels 26 are rotatably mounted to the bottom plate 30 of the base section 16 of the nozzle assembly 12. In contrast, the rear wheels 28 are rotatably mounted to the canister assembly 18. Together, the wheels 26, 28 function to allow the vacuum cleaner 10 to roll smoothly across the surface during the cleaning operation.

In order to allow for convenient storage of the vacuum cleaner 10, a foot latch 32 functions to lock the canister assembly 18 in an upright position as shown in FIGS. 1 and 2. When the foot latch 32 is released, the canister assembly 18 may be pivoted relative to the base section 16 of the nozzle assembly 12 as the vacuum cleaner 10 is manipulated back-and-forth to clean the floor.

As further illustrated in the drawing figures, the canister assembly 18 includes a main housing 34 that defines an internal cavity that is closed by a selectively removable main housing door 36. The cavity is adapted to receive and hold a dust bag 38 constructed from a filter material that functions to collect dirt and debris in a manner known in the art. While the illustrated embodiment includes a cavity and dust bag 38, it should be appreciated that the vacuum cleaner 10 could just as easily be equipped with a removable dirt cup having a dirt collection chamber. That chamber may be cylindrical in shape and include a tangentially directed inlet opening in order to provide cyclonic airflow if desired.

As further illustrated in the drawing figures the canister assembly 18 also carries a suction generator 40 comprising a fan and drive motor. The suction generator 40 functions to generate a vacuum airstream for drawing dirt and debris from the surface to be cleaned. While the suction generator 40 is illustrated as being carried on the canister assembly 18, it should be appreciated that it could likewise be carried on the nozzle assembly 12 if desired.

As previously indicated, the nozzle assembly 12 includes both an agitator section 14 and a base section 16. As will become apparent as the description hereof proceeds, the agitator section 14 is pivotally mounted to the base section 16 so that the agitators are better able to follow the contour of the surface being cleaned in order to provide more efficient cleaning action without causing undue wear to vacuum cleaner components or the surface being cleaned.

As illustrated in FIGS. 3-6, the agitator section 14 includes a housing having an upper portion or hood 44 and a lower portion or plate 46. Together, the hood 44 and plate 46 define an agitator cavity for holding a first rotary agitator 48 and a second rotary agitator 50. The agitators 48, 50 are interconnected at one end by means of a gear box assembly 52 held in a first socket 54 provided at one side of the agitator section 14. The opposite ends of the agitators 48, 50 are received in a bearing unit assembly 56 held in a second socket 58 at the opposite side of the agitator section 14.

In the illustrated embodiment the agitators 48, 50 are driven by the motor of the suction generator 40 through means of a power transmission generally designated by reference numeral 60. That power transmission comprises a first belt 62 connecting the output shaft of the motor of the suction generator 40 with a first pulley 64 of the step down pulley assembly 66. The first pulley 64 shares a common shaft with the second pulley 68 of the step down pulley assembly 66. A second belt 70 connects the second pulley 68 of the step down pulley assembly 66 with a pulley 72 formed as a part of the first agitator 48. During normal vacuum cleaner operation, rotary power is transferred from the drive shaft of the motor of the suction generator 40 through the first belt 62, first and second pulleys 64, 68 of the step down pulley assembly 66 and the second belt 70 to the first rotary agitator 48. The gear box assembly 52 transfers rotary motion from the first rotary agitator 48 to the second rotary agitator 50. A tensioner assembly, generally designated by reference numeral 74, may be actuated by the operator to detension the second belt 70 and thereby interrupt drive to the rotary agitators 48, 50 while allowing the motor to continue to drive the suction generator 40. This allows more efficient and effective bare floor cleaning.

Figure 3:
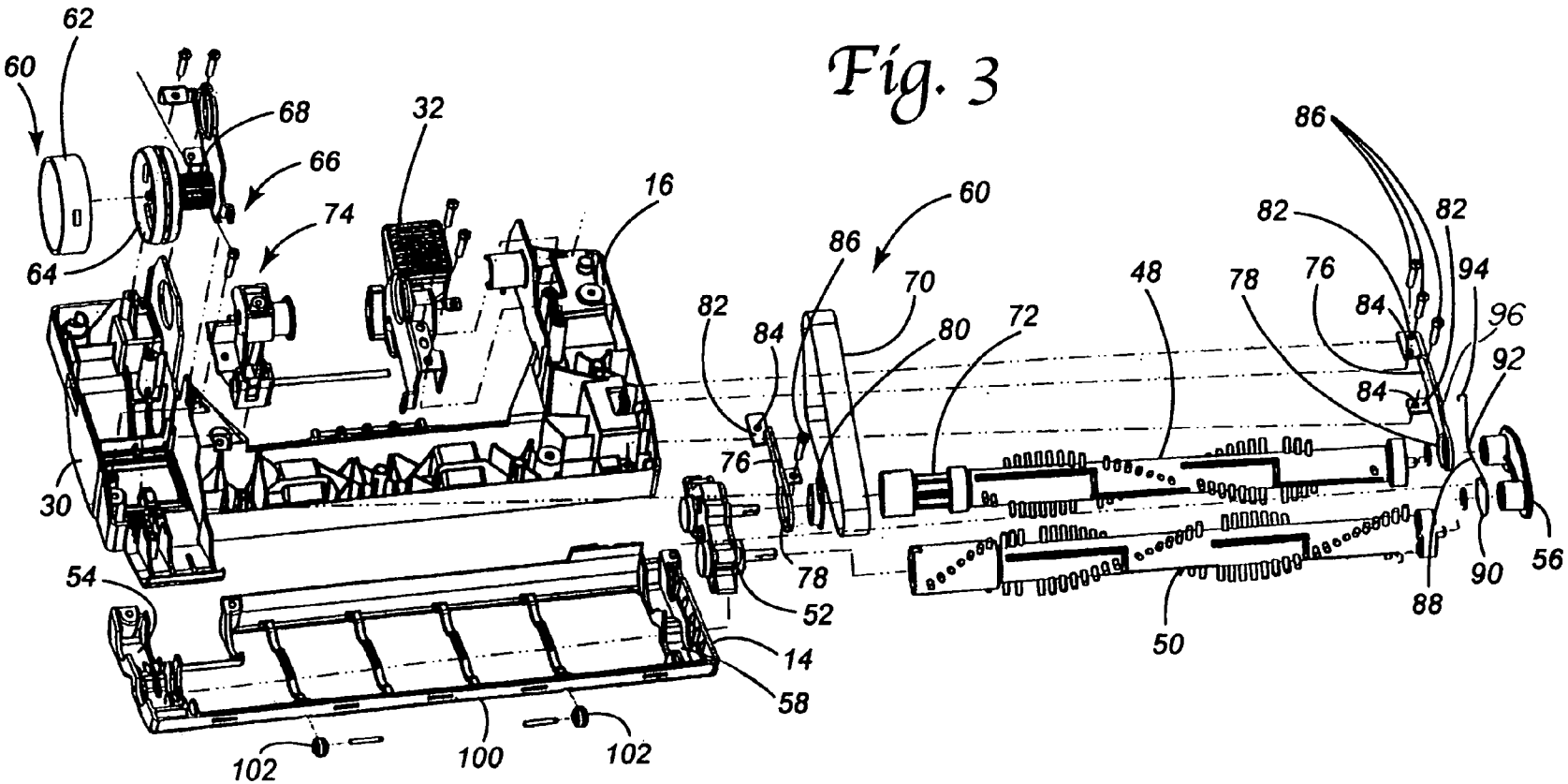
FIG. 3 is a detailed, exploded perspective view of the nozzle assembly of the upright vacuum cleaner illustrated in FIGS. 1 and 2;.

As illustrated in FIG. 3, the agitator section 14 is pivotally connected to the base section 16 of the nozzle assembly 12 by means of a pair of brackets 76. Each bracket 76 includes an aperture 78 that engages a bushing 80 at an end of the first rotary agitator 48. Thus, one bracket 76 is effectively captured between the first rotary agitator 48 and the gear box assembly 52 while a second bracket 76 is effectively captured between the opposite end of the rotary agitator 48 and the bearing unit assembly 56. As a result of the pivotal connection by the brackets 76, the agitator section 14 pivots through an arc of between about 10 degrees to about 25 degrees relative to the base section 16. More specifically, the agitator section 14 will pivot upward above alignment with the base section 16 up to about 5 degrees. The agitator section 14 will also pivot downward below alignment with the base section 16 up to about 15 degrees. This free pivoting movement of the agitator section 14 relative to the base section 16 allows the agitators 48, 50 to follow floor contours and step over the raised edges of thresholds, rugs and the like with minimal resistance. This allows the user to smoothly and comfortably push the vacuum cleaner across substantially any surface to be cleaned.

As further illustrated, each bracket 76 includes a pair of projecting lugs 82. Each lug includes at least one aperture 84 for receiving a fastener 86 such as a screw. The fasteners 86 engage in threaded apertures provided on the bottom plate 30 of the base section 16 of the nozzle assembly 12. A spring 88 includes (a) a ioop 90 received over a first portion of the bearing unit assembly 56 receiving an end of the second rotary agitator 50, (b) an intermediate bend 92 engaged by a second portion of the bearing unit assembly 56 that receives the end of the first rotary agitator 48 and (c) a hook end 94 that engages in a notch 96 on a top edge of one of the brackets 76. While only one spring 88 is shown, it should be appreciated that if desired, a second, like spring may be provided at the opposite side of the agitator section 14 adjacent gear box assembly 52. Similarly, no springs can be used if desired.

As should be appreciated, the spring 88 biases the agitator section 14 downwardly with respect to the base section 16 into engagement with the underlying floor. Accordingly, a positive downforce of approximately 0.5 (newtons) is provided on the agitator section 14 in order to maintain the agitators 48 and 50 in cleaning contact with the underlying floor. This downforce enhances cleaning efficiency and also reduces vibration during the cleaning process.

It should be appreciated that the pivotal mounting of the agitator section 14 to the base section 16 of the nozzle assembly 12 ensures that the agitator section 14 is capable of free movement in order to follow the contour of the floor including raised thresholds and the edges of rugs commonly provided over bare floors. As should be appreciated, the leading edge 100 of the agitator section 14 at the front of the vacuum cleaner 10 opposite the base section 16 includes at least two guide wheels 102. These guide wheels 102 are normally not in engagement with the floor but will, for example, come into engagement with raised features such as raised thresholds and the edges of rugs as the vacuum cleaner 10 is pushed across the floor. Thus, the guide wheels 102 insure that the agitator section 14 steps smoothly over raised features that might be encountered during vacuum cleaner operation.

As best illustrated with reference to FIGS. 4, 5 and 6, the hood 44 includes a wall 116 and a baffle 118. A first section 120 of the wall 116 and the baffle 118 define a first channel 122. A second section 124 of the wall 116 and the baffle 118 define a second channel 126. At least the upper portion of the first agitator 48 is received in the first channel 122 while at least the upper portion of the second agitator 50 is received in the second channel 126.

Figure 4:
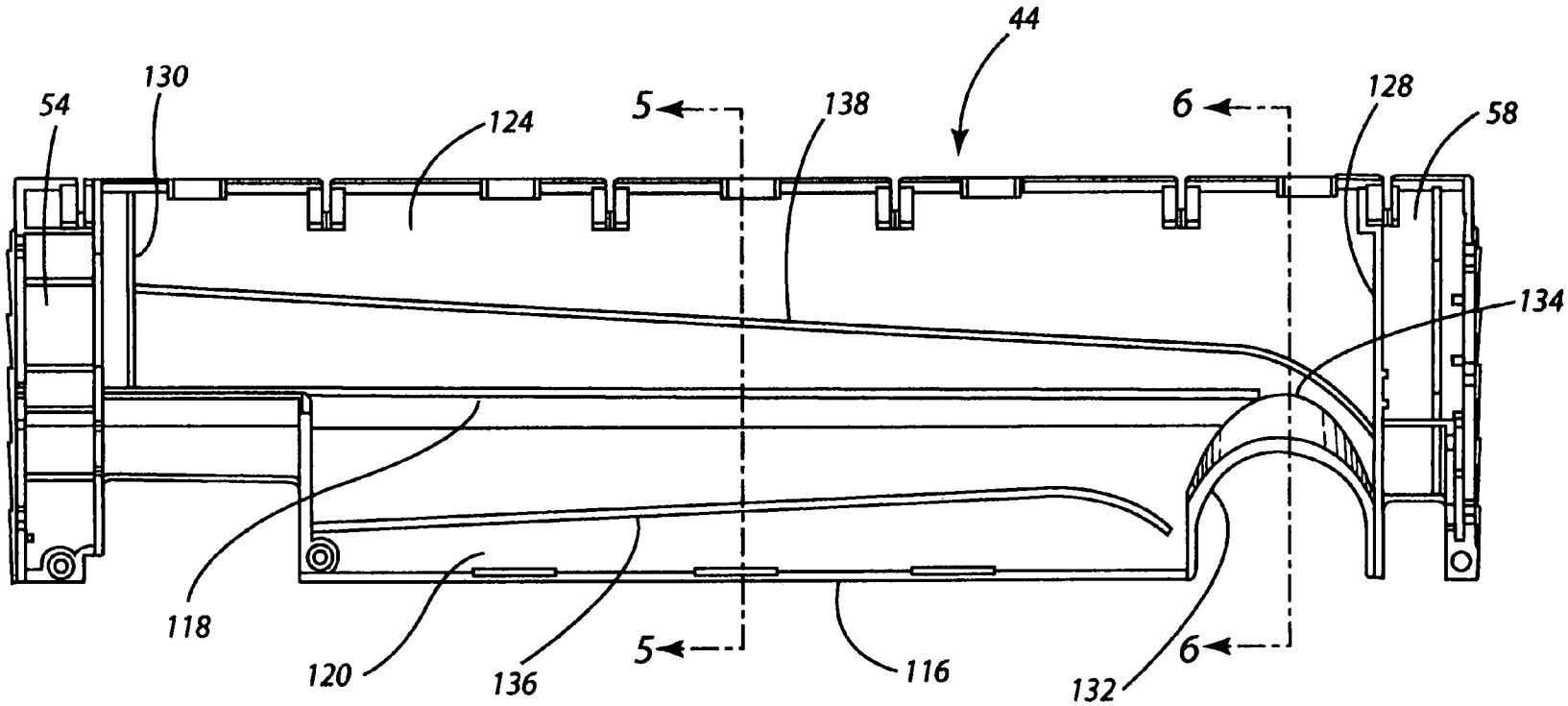
FIG. 4 is atop plan view of the agitator hood of the present invention.
Figure 5:
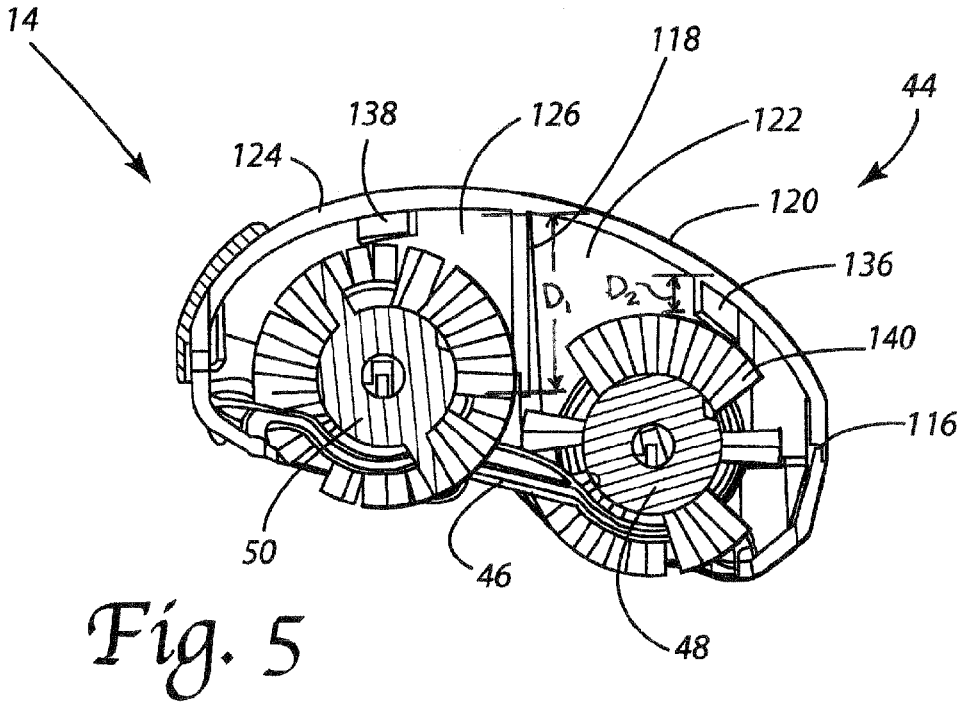
FIG. 5 is a cross-sectional view through the entire agitator section including the agitator hood taken along line 5-5 of FIG. 4.

The hood 44 also includes a first sidewall 128 and a second sidewall 130 (see specifically FIG. 4). An intake opening 132 is provided in the first section 120 of the wall 116 adjacent the first sidewall 128. The first agitator 48 and the first channel 122 extend between the two sidewalls 128, 130. The second agitator 50 and the second channel 126 extend parallel to the first agitator 48 and first channel 122 between the two sidewalls 128, 130. The baffle 118 extends from the second sidewall 130 toward the first sidewall 128 between the two agitators 48,50.

Figure 6:
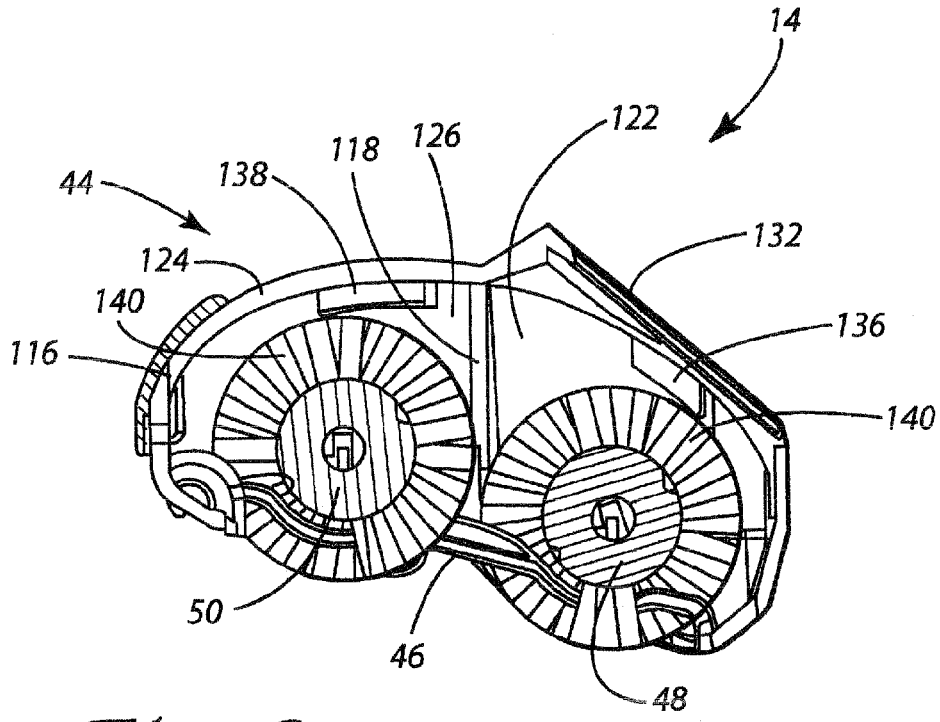
FIG. 6 is a cross-sectional view similar to FIG. 5 but taken along line 6-6 of FIG. 4 through the intake opening.

In the illustrated embodiment, a gap 134 is provided between an end of the baffle 118 and the first sidewall 128 so as to be at least partially aligned with the intake opening 132 (see FIGS. 4 and 6). This gap 134 allows air to flow smoothly from the second channel 126, across the first channel 122 into the intake opening 132.

A first air guide rib 136 is carried on the first section 120 of the wall 116. A second air guide rib 138 is carried on the second section 124 of the wall 116. As should be appreciated, the baffle 118 projects from the wall 116 a distance $D_1$ of between about 19 mm and about 29 mm. In contrast, the air guide ribs 136, 138 project from the wall 116 a distance $D_2$ of between about 4 mm and about 5 mm. The distance $D_1$ is about three to about five times greater than the distance $D_2$. As a result, the baffle 118 extends in between the agitators 48, 50 whereas the air guide ribs 136, 138 extend nearly to the agitators 48, 50 (note slight clearance between air guide ribs and bristles 140 of agitators illustrated in FIGS. 5 and 6). Further, each air guide rib 136, 138 includes an arcuate end curved toward the intake opening 132. The air guide rib 136 curves toward the interior side of the intake opening 132 while the air guide rib 138 curves toward the exterior side of the intake opening.

Due to the longer length, the baffle 118 functions to divide the agitator cavity into two channels 122, 126, one for each agitator 48, 50. As the agitators 48, 50 rotate, they produce some turbulent air flow. The baffle 118 functions to significantly reduce the detrimental interaction of the turbulent airflow produced by the two, separate agitators 48, 50. At the same time, the shorter air guide ribs 136, 138 function to reduce swirling in each channel 122,126 and direct airflow in each channel toward the intake opening 132. Thus, the baffle 118 and the air guide ribs 136, 138 function together to smooth and direct airflow toward the intake opening 132 thereby providing more efficient and effective sweeping of dirt and debris entrained in that airflow through the agitator cavity into the intake opening.

As the vacuum cleaner 10 is operated, the rotary agitators 48, 50 brush and beat dirt and debris from the nap of an underlying carpet being cleaned. That dirt and debris is drawn along the two agitators 48, 50 and the air guide ribs 136, 138 in each channel 122, 126 by the negative air pressure generated by the suction generator 40 and then sucked smoothly and efficiently into the intake opening 132. That air with entrained dirt and debris is then drawn through the hose 106, wand fitting 108, wand 110 and hose 112 for delivery through an inlet (not shown) to the canister assembly 18 in communication with the dust bag 38. Dirt and debris is trapped in the dust bag 38 while clean air is then drawn through the suction generator 40 and passed over the motor of the suction generator to provide cooling. That air is passed through a final filter (not shown) and exhausted into the environment through the exhaust port 114.

The foregoing description of the invention has been presented for purposes of illustration and description. It is not intended to be exhaustive or to limit the invention to the precise form disclosed. Obvious modifications or variations are possible in light of the above teachings. For example, the vacuum cleaner could include three or more agitators and the hood could include a number of additional baffles sufficient to provide a separate channel for each agitator. The intake opening could also be positioned farther from the first sidewall if desired, more toward the middle of the first chamber. The gap could be moved in a similar manner to be at least partially aligned with the intake opening along a mid portion of the baffle. Further, while an upright vacuum cleaner is disclosed, the concepts are equally applicable to a powerhead for a canister vacuum cleaner or even to an extractor: devices also covered by this invention.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A floor cleaning apparatus, comprising:
- a nozzle assembly including a housing and a cooperating hood defining an agitator cavity;
- a first agitator carried by the nozzle assembly in said agitator cavity;
- a second agitator carried by said nozzle assembly in said agitator cavity;
- a canister assembly connected to said nozzle assembly;
- a suction generator carried by one of said canister assembly and said nozzle assembly;
- a dirt collector carried by one of said canister assembly and said nozzle assembly;
- said hood including a wall, a first sidewall, a second sidewall and a baffle, a first section of said wall and said baffle defining a first channel receiving at least a first portion of said first agitator and a second section of said wall and said baffle defining a second channel receiving at least a second portion of said second agitator;
- an intake opening provided in said first section of said wall adjacent said first side wall; and
- said first agitator extending across said first channel between said first sidewall and said second sidewall.

2. The floor cleaning apparatus of claim 1, wherein said second agitator extends across said second channel between said first sidewall and said second sidewall.

3. The floor cleaning apparatus of claim 2, wherein said baffle extends from said second sidewall toward said first sidewall at least partially between said first and second agitators.

4. The floor cleaning apparatus of claim 3, wherein a gap is provided between said first sidewall and said baffle, said gap being at least partially aligned with said intake opening.

5. The floor cleaning apparatus of claim 4, further including a first air guide rib carried on said first section of said wall and a second air guide rib carried on said second section of said wall.

6. The floor cleaning apparatus of claim 5, wherein said baffle projects from said wall a distance $D_1$ and said first and second air guide ribs project from said wall a distance $D_2$ where $D_1$ is about three to about five times greater than $D_2$.

7. The floor cleaning apparatus of claim 1, wherein a gap is provided between said baffle and said first sidewall, said gap being at least partially aligned with said intake opening.

8. The floor cleaning apparatus of claim 7, wherein said second agitator extends across said second channel between said first sidewall and said second sidewall.

9. The floor cleaning apparatus of claim 8, further including a first air guide rib carried on said first section of said wall and a second air guide rib carried on said second section of said wall.

10. The floor cleaning apparatus of claim 9, wherein said baffle projects from said wall a distance $D_1$ and said first and second air guide ribs project from said wall a distance $D_2$ where $D_1$ is about three to about five times greater than $D_2$.

* * * * *